US005271176A

United States Patent [19]

Anderson et al.

[11] Patent Number: 5,271,176

[45] Date of Patent: Dec. 21, 1993

[54] FLEXIBLE BULLET HOLDER FOR USE ON WRISTS

[75] Inventors: Robert A. Anderson; Eric D. Anderson, both of Oak Harbor, Wash.

[73] Assignee: Anderson Manufacturing Company, Inc., Oak Harbor, Wash.

[21] Appl. No.: 967,247

[22] Filed: Oct. 27, 1992

Related U.S. Application Data

[62] Division of Ser. No. 817,782, Jan. 8, 1992, Pat. No. 5,183,953.

[51] Int. Cl.[5] ..... F41C 27/00; A45F 5/00

[52] U.S. Cl. ..... 42/106; 224/219

[58] Field of Search ..... 224/219-222, 224/203; 42/74, 87, 88, 106, 71.01

[56] References Cited

U.S. PATENT DOCUMENTS

| | | | |
|---|---|---|---|
| 635,145 | 10/1899 | Orndorff | 224/219 |
| 1,603,044 | 10/1926 | Gise | 224/221 |
| 2,410,200 | 10/1946 | Celestin | 224/219 |
| 2,605,033 | 7/1952 | Terry | 42/71.01 |
| 4,061,256 | 12/1977 | Beer et al. | 224/219 |
| 4,069,954 | 1/1978 | Rauch | 224/219 |
| 4,746,043 | 5/1988 | Booker | 224/219 |
| 4,830,246 | 5/1989 | Ryan | 224/219 |
| 4,896,465 | 1/1990 | Rhodes et al. | 224/219 |

*Primary Examiner*—David H. Brown
*Attorney, Agent, or Firm*—Jensen & Puntigam

[57] ABSTRACT

The bullet holder includes a closed band (50) which includes a foam rubber element (53) and a fabric layer (60) which lies adjacent to and is attached to the outer surface of the foam rubber element (53). In the band (50) are located a plurality of opposed sets of openings (52-55), each pair of openings holding a bullet. The openings are smaller than the size of the bullets to be held, but expand readily upon insertion of the bullet.

2 Claims, 2 Drawing Sheets

FLEXIBLE BULLET HOLDER FOR USE ON WRISTS

This is a division of application Ser. No. 817,782, filed on Jan. 8, 1992 now U.S. Pat. No. 5,183,953.

1. Technical Field

This invention generally concerns accessories for rifles and pistols, and more particularly concerns a combination cover and guard for a telescoping sight mounted on rifles and/or pistols.

2. Background Of The Invention

Telescoping sights are a common accessory for use with rifles and pistols to aid in the accurate sighting of a target. Historically, such "scopes" have been equipped with small caps which fit over the lenses located at the opposing ends of the scopes to provide protection for the .lenses from the weather and other conditions, including keeping water and snow from those areas of the scope. In addition to protecting the lenses of the scope, the use of lens caps results in the scope being easier to sight immediately after removal of the lens caps in adverse weather conditions.

In addition to the caps for the opposing ends of the scope, some cover devices are known which cover the entire scope, although such covers are not common.

However, a significant problem with both the lens caps and the few covers which are known is the large number of sizes required to adequately fit all of the sizes of scopes on the market. This creates a difficult problem for the manufacturer as well as the retailer in maintaining an appropriate inventory.

In addition, with the increasing sophistication of telescoping sights, having new structural features, including electronic circuitry, it is often desirable to provide physical protection for the entire scope to prevent possible damage to the scope and even to prevent/lessen environmental shock when the scope is, for instance, removed from a relatively warm environment, such as a vehicle, into adverse weather condition. Protective devices for scopes are quite limited, and are susceptible to the disadvantages of size and configuration ranges discussed above.

DISCLOSURE OF THE INVENTION

Accordingly, the present invention is a cover/guard for use with rifle and pistol scopes, comprising: a cover element which includes a main body section which extends for the length of the scope and two end sections which are secured to the ends of the main body section in such a manner that the main body section is approximately U-shaped in configuration with closed ends, so that the main body section, when placed on a scope, extends over the top of and down the sides of the scope and the end sections extend down the front and rear ends of the scope, wherein the cover element includes a stretchable, flexible, resilient protective inner portion and a stretchable fabric outer portion secured to the inner portion, permitting said sections of the cover element to be conveniently sewn together and thereafter to be stretched together to fit over the scope.

BEST MODE FOR CARRYING OUT THE INVENTION

Figure 1:
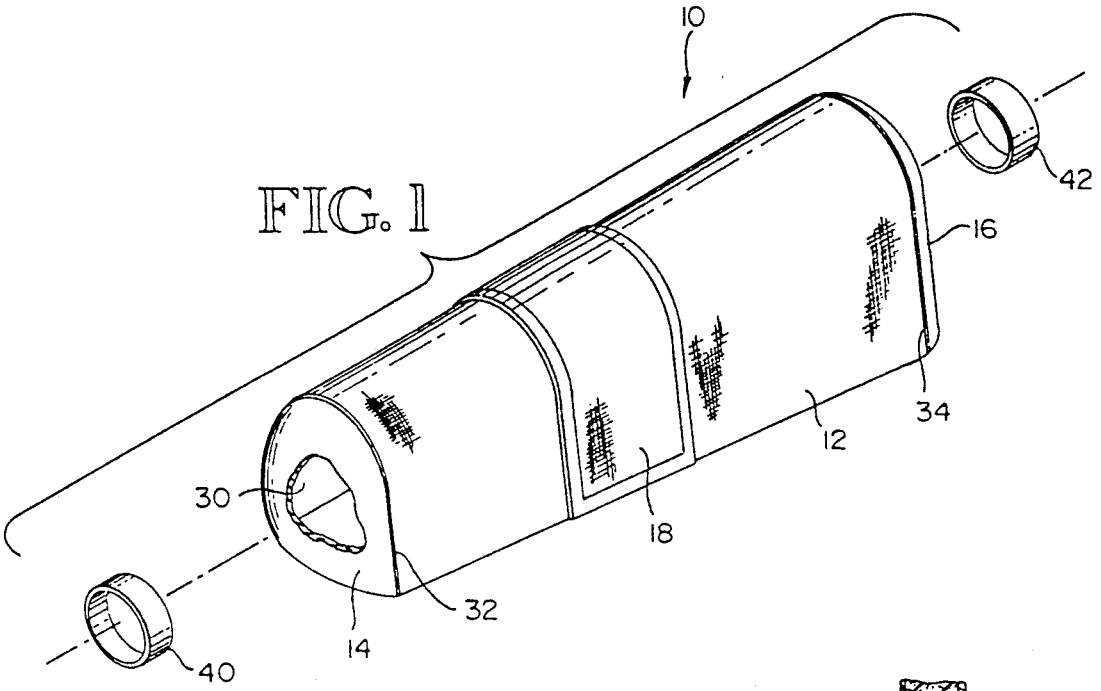
FIG. 1 shows the overall configuration of the scope cover/guard of the present invention.
Figure 2:
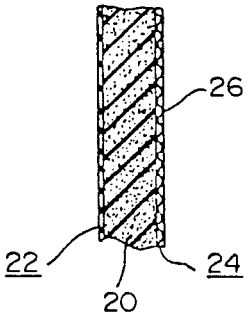
FIG. 2 shows a partial section view of the scope cover/guard of FIG. 1, showing the material comprising the cover/guard.

FIGS. 1 and 2 show the scope cover/guard of the present invention, referred to generally at 10. In the embodiment shown, the cover/guard 10 generally comprises three parts or sections. The first part is a central body section 12 which in the embodiment shown is approximately 8" long and 5-½" wide at one end, tapering outwardly to 6-½" at the other end, so that the cover/guard 10 is slightly larger at one end. Two sizes of the scope cover/guard of the present invention are sufficient to cover all available scopes, which range from 8 to 15 inches long.

The second part of cover/guard 10 is a pair of end sections 14 and 16. Each end section 14,16 in the embodiment shown is horseshoe-shaped or approximately U-shaped, approximately 2" long at its highest point and 1¾" wide at its widest point, with the bottom edge being slightly less than the widest point. The third part is a middle section 18. In the embodiment shown, the middle section, which is attached across the main body section 12 at its approximate midpoint, is approximately 5-½" long by 1-¾" wide.

One of the significant features of the present invention is its construction. Referring to FIG. 2, the material comprising each of the above parts includes a resilient, cushioning portion 20 which in the embodiment shown is a ½" thick layer of rubber material. The thickness could vary. Resilient portion 20 is stretchable so as to conveniently fit over a scope and be maintained in place thereon. The interior surface 22 of portion 20 is a "skin" surface, which is smooth but is characterized by a gripping capability, so that the interior surface 22 tends to grip the surface of the scope, preventing the cover/guard from slipping off, once the article is stretched around and onto the scope. In the embodiment shown, portion 20 is foam rubber, such as Neoprene, with one side thereof being treated, such as by heat, to provide the "skin" surface.

On the exterior surface 24 of portion 20 is bonded a layer 26 of woven fabric, such as nylon. This outer layer 26 of fabric acts as an initial barrier to various environmental weather conditions, including water, and further permits all of the parts of the cover/guard to be readily sewn together.

The end sections 14 and 16 of the cover/guard are sewn around edge portion 30 thereof (part 14 is exemplary) to the respective end edges 32 and 34 of the main body section 12, thereby forming the basic stretchable scope cover/guard. The middle section 18 is then attached, such as by sewing, laterally across the main body section 12, at approximately the longitudinal midpoint thereof. The middle section 18 provides additional protection for windage and elevation adjustment mechanisms of the scope.

Figure 3:
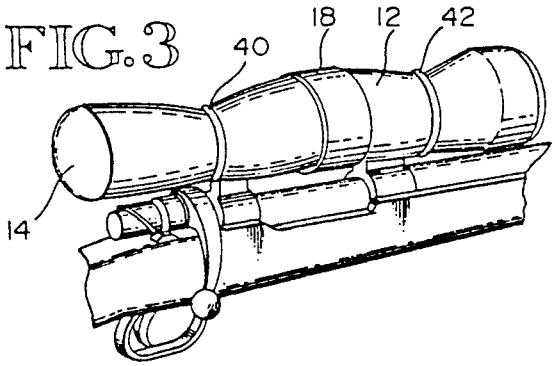
FIG. 3 shows the scope cover/guard of the present invention fully covering a scope.
Figure 4:
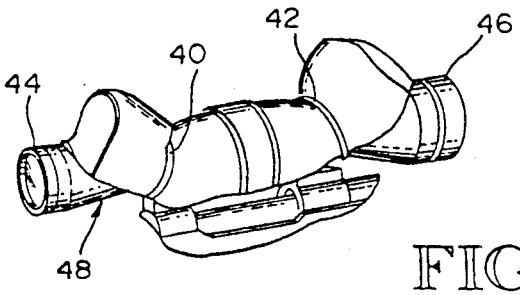
FIG. 4 is similar to FIG. 3 and shows the scope cover/guard partially removed from a scope.

Two circular bands 40 and 42 assist in maintaining the scope cover/guard 10 on the scope. Each band, i.e. band 40, is made out of stretchable rubber, approximately ¼" wide and ¾" in diameter in the embodiment shown, and may be conveniently maneuvered to surround the scope and the cover/guard. This is shown in FIG. 3. The significant advantage to the bands 40 and 42 in the resent invention is that the respective end portions of the scope cover/ guard may be raised up above the corresponding ends of the scope, as shown in FIG. 4, to reveal the two ends 44 and 46 of the scope 48, permitting the scope to be used without having to completely remove the scope cover/guard. When the scope is not in use, the cover/guard is positioned so that the scope is completely covered, as shown in FIG. 3.

The cover/guard 10 may easily be stretched 4–5" in length from its "rest" configuration so that it conveniently can be fitted to scopes of varying dimensions. The cover/guard furthermore is wide enough to substantially cover, i.e. extend over the top and down the sides of a large variety of scope sizes and configurations, including relatively large diameter scopes having electronics packages. When the cover/guard is stretched to fit over the scope, the cushioning material provides physical protection for the scope. The thicker the material, the more cushion protection is provided. It also serves as insulation for the scope and eases the transition between a relatively warm environment, such as in a vehicle, to adverse environmental conditions, including below zero temperatures. This is particularly important for more sophisticated electronic scopes. While the cover/guard 10 is typically not directly attached to the scope, it can be, if desired. Further, the cover/guard, being made of relatively soft material, can be quietly removed from the scope during hunting and will not produce a sound if struck. If desired, the scope cover/-guard can be made with different colors, such as camouflage, or a very bright color.

Figure 5:
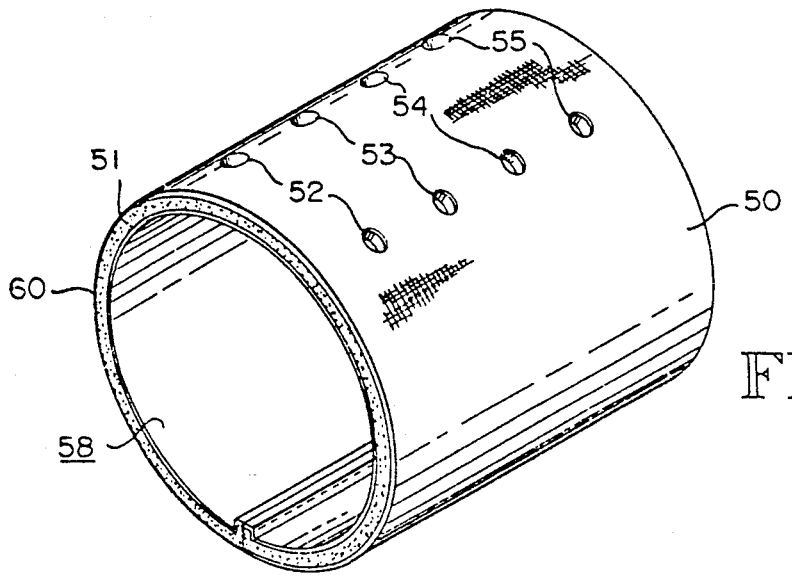
FIGS. 5 and 6 show a bullet wrist band, including the details of the openings for the bullets.
Figure 6:
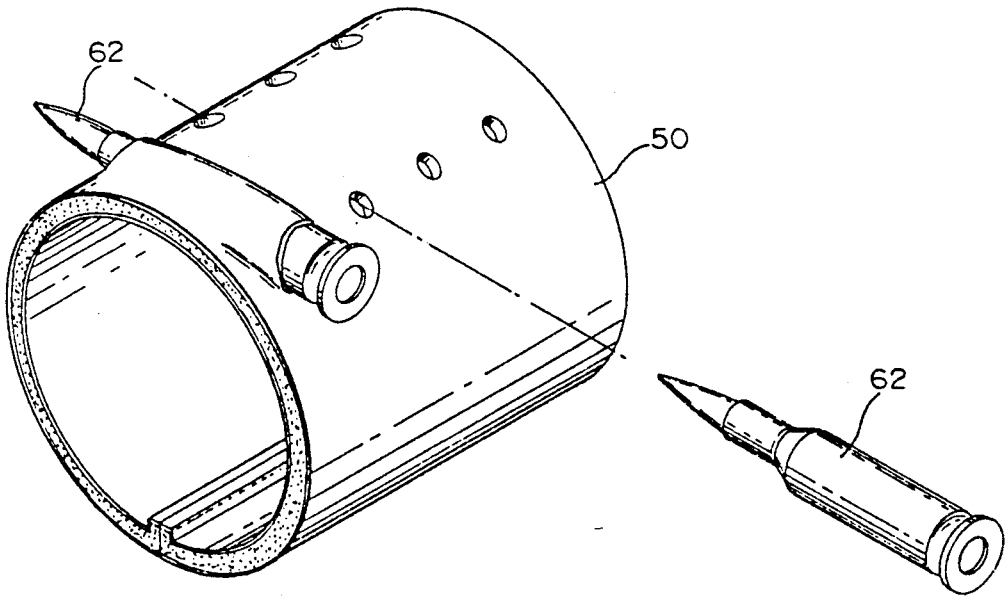

A bullet holder is shown in FIGS. 5 and 6. This invention includes a closed band 50, which in the embodiment shown comprises the same combination of elements as he cover/guard described above. In particular, band 50 comprises a foam rubber element 51 which is heat-treated on the interior surface 58 thereof to produce a skin surface which is smooth but has a gripping capability. A fabric layer 60 is secured to the outer surface thereof. In the embodiment shown, band 50 is approximately 3" in diameter, which is sufficient to fit over the wrist or lower forearm of the user, or perhaps a portion of a rifle. Two different sizes accommodate nearly every user.

Typically, band 50 comprises a length of the above-described material, the ends of which are then sewn together, to form a continuous band.

In the band 50 are located a plurality of opposing sets of openings 52 through 55. Although four sets of such openings are shown in FIGS. 5 and 6, it should be understood that fewer or more sets of openings could be provided. In the embodiment shown, the openings, in their rest configuration, are approximately $\frac{1}{8}$" in diameter. The two holes in each set are approximately 1-$\frac{1}{4}$" apart. This arrangement allows for bullets of various sizes to be inserted through each set of two openings, such that they are readily available to the user.

The primary advantages of the bullet holder shown in FIGS. 5 and 6 are its simplicity, its convenience for the user, and its ability to hold a number of different size bullets 62—62 due to the stretchable nature of the material comprising the band. The band 50 itself holds the bullets rather than any external loops or other elements. The bullets are held quite firmly, even during violent movement of the user's limb, yet are easy to insert and remove.

Although a preferred embodiment of the inventions described herein have been disclosed herein for illustration, it should be understood that various changes, modifications and substitutions may be incorporated in such embodiments without departing from the spirit of the invention which is defined by the claims which follow:

What is claimed is:

1. A bullet holder, comprising:

a body member defining a closed loop, configured to be positioned on a limb of a user, wherein the body member includes a stretchable, flexible, resilient inner portion and a stretchable fabric outer portion lying adjacent to and attached to the inner portion along the entire length thereof, wherein the body member further includes a plurality of sets of openings therethrough, wherein each set of openings comprises two spaced-apart openings, the openings being smaller than the diameter of bullets to be held therein, but which readily expand upon insertion of a bullet, the body member thereby holding the bullets firmly therein by virtue of the resilience of the body member.

2. An article of claim 8, wherein the inner portion is foam rubber.

* * * * *